United States Patent [19]

Glenn

[11] 3,963,588

[45] June 15, 1976

[54] COALESCENT-JET APPARATUS AND METHOD FOR HIGH CURRENT DENSITY PREFERENTIAL ELECTROPLATING

[75] Inventor: Richard C. Glenn, Hempfield Township, Westmoreland County, Pa.

[73] Assignee: United States Steel Corporation

[22] Filed: Apr. 21, 1975

[21] Appl. No.: 570,061

[52] U.S. Cl. ..... 204/16; 204/224 R; 204/DIG. 7

[51] Int. Cl.[2] ..... B23K 28/00; C25D 5/02

[58] Field of Search ..... 204/16, 224 R, DIG. 7, 204/15

[56] References Cited

UNITED STATES PATENTS

| | | | |
|---|---|---|---|
| 1,416,929 | 5/1922 | Bailey | 204/224 R |
| 2,695,269 | 11/1954 | De Witz et al. | 204/206 |
| 2,750,332 | 6/1956 | Miller | 204/224 R |
| 3,809,642 | 5/1974 | Bond et al. | 204/DIG. 7 |

FOREIGN PATENTS OR APPLICATIONS

| | | | |
|---|---|---|---|
| 1,147,730 | 11/1957 | France | 204/224 R |
| 986 | 1896 | United Kingdom | 204/DIG. 7 |

*Primary Examiner*—T. M. Tufariello
*Attorney, Agent, or Firm*—A. J. Greif

[57] ABSTRACT

A process and apparatus for the high current density electroplating of recessed configurations such as inside corners or depressions. The apparatus employs a housing member, the front face of which has a number of closely spaced ports for the discharge of electrolyte jets which impinge upon the recessed configuration. The anode, supported within the housing, is non-consumable so as to prevent soluble anode products from depositing within the recessed configuration. Uniform plating is achieved by a new principle termed "coalescent jets" which requires a critical correlation between (i) the applied voltage, (ii) the force of the electrolyte jets, (iii) the size of the ports, (iv) the distance between ports and (v) the distance between the front face of the housing and the recessed configuration undergoing electroplating.

12 Claims, 12 Drawing Figures

COALESCENT-JET APPARATUS AND METHOD FOR HIGH CURRENT DENSITY PREFERENTIAL ELECTROPLATING

This invention relates to a process and apparatus useful in the electroplating of a metal upon a recessed configuration (e.g. a corner or depression) within a metal substrate. More specifically, this invention is directed to an apparatus comprising an anode housing which is particularly suitable for effecting requisite agitation of the electrolyte, sufficient to support high current density electroplating.

It is often desirable, such as in the repair of certain metal parts, to selectively electroplate the damaged part so as to refill a depression therein. In order to achieve high production rates, it is desirable to achieve as high a deposition rate as possible through the utilization of high current densities. The term "high current density" is quite relative since it is significantly dependent on both the electrolyte employed and the configuration of the substrate being plated. Thus, for example, in the electroplating of copper for the refurbishing of continuous casting molds, present commercial practice generally employs current densities of less than about 50 amps/ft$^2$; whereas rates significantly greater than this are considered high current density for this application. By contrast, in the electroplating of chromium, current densities of the order of 1000 amps/ft$^2$ are very commonplace. Therefore, for purposes of this invention the term "high current density" will mean a current density which can only be supported, depending on the metal being plated, by the use of violent agitation of the electrolyte. In order to achieve effective circulation of the electrolyte, the art has generally resorted to methods of agitation in which the solution flows in a direction more or less parallel to the plane of the substrate undergoing plating. With respect to the electroplating of recessed configurations, such electrolyte agitation methods have, in general, been unsatisfactory since the electrolyte does not effectively reach all portions of the depression in a uniform manner, resulting in excessive plating around the edges of the depression.

It is therefore a principle object of this invention to provide a method and apparatus for achieving uniform or preferential plating of recessed configurations at high current densities.

Figure 1:
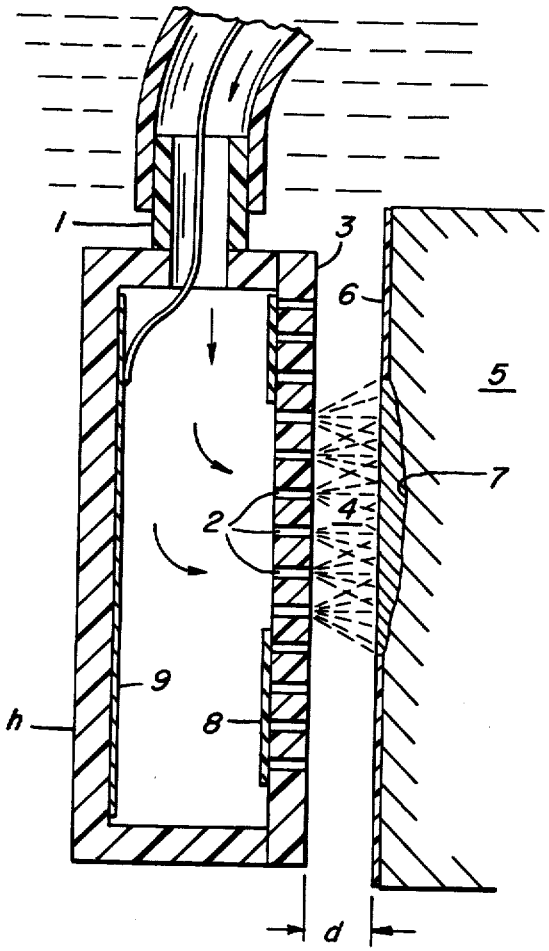
Figure 5:
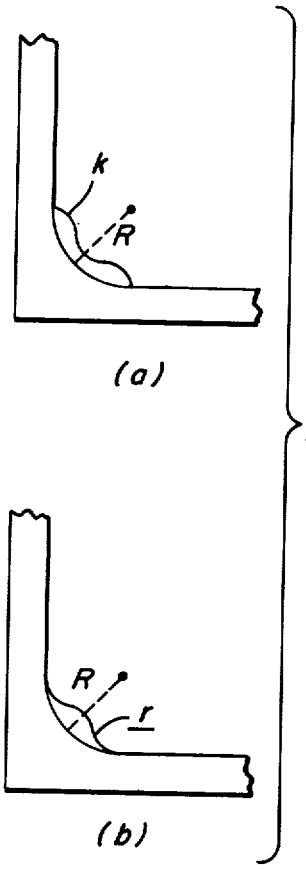
Figure 6:
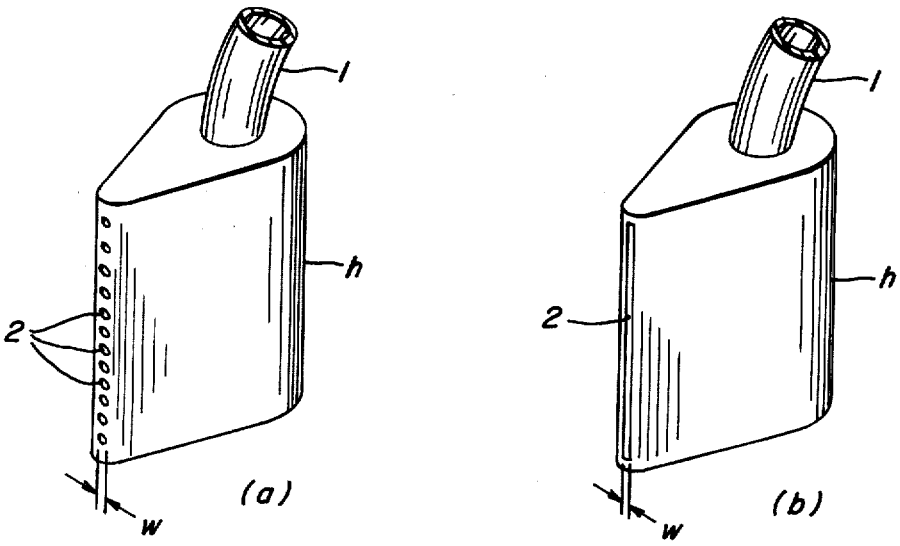
Figure 2:
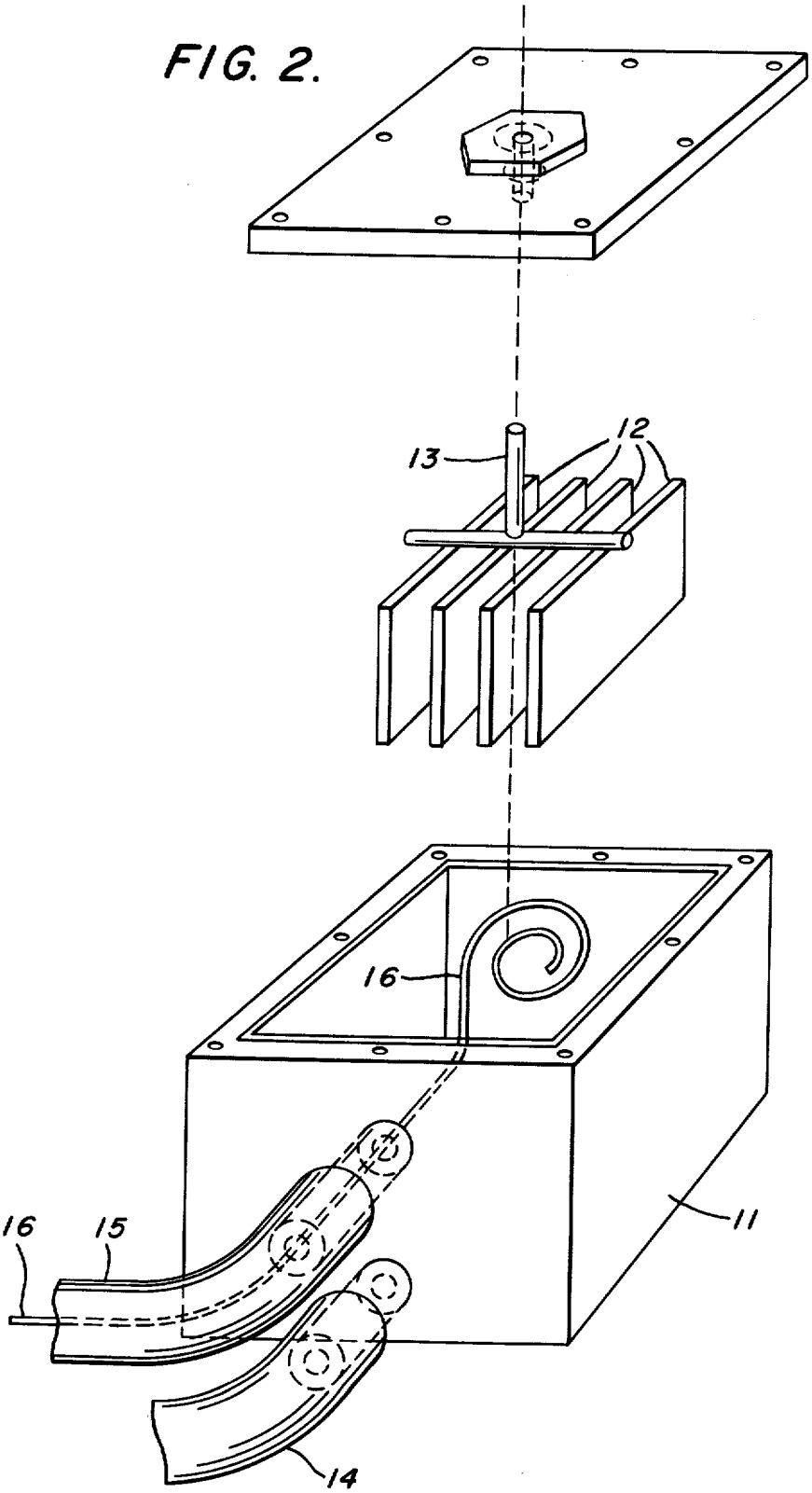
Figure 3A:
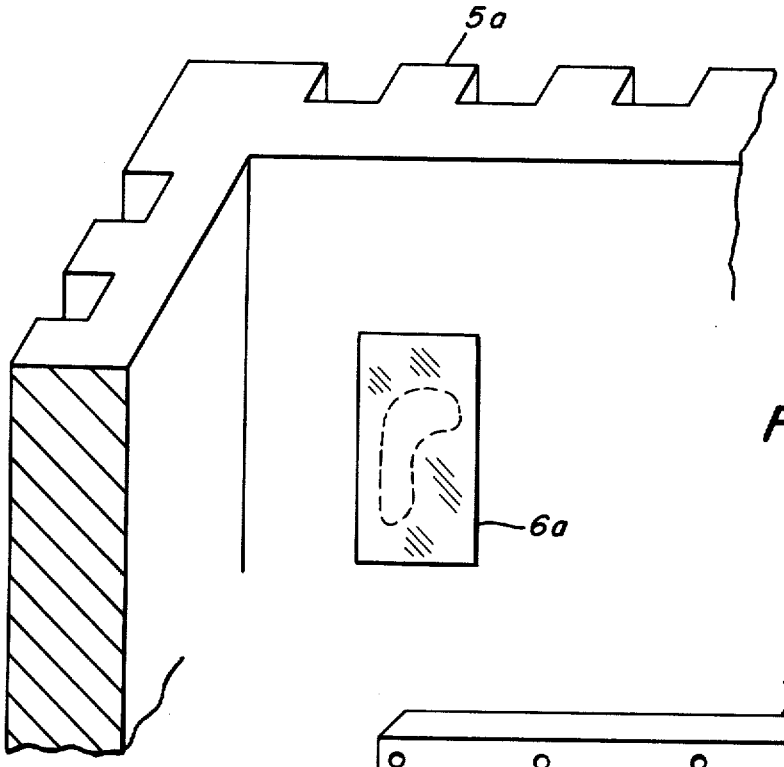
Figure 3B:
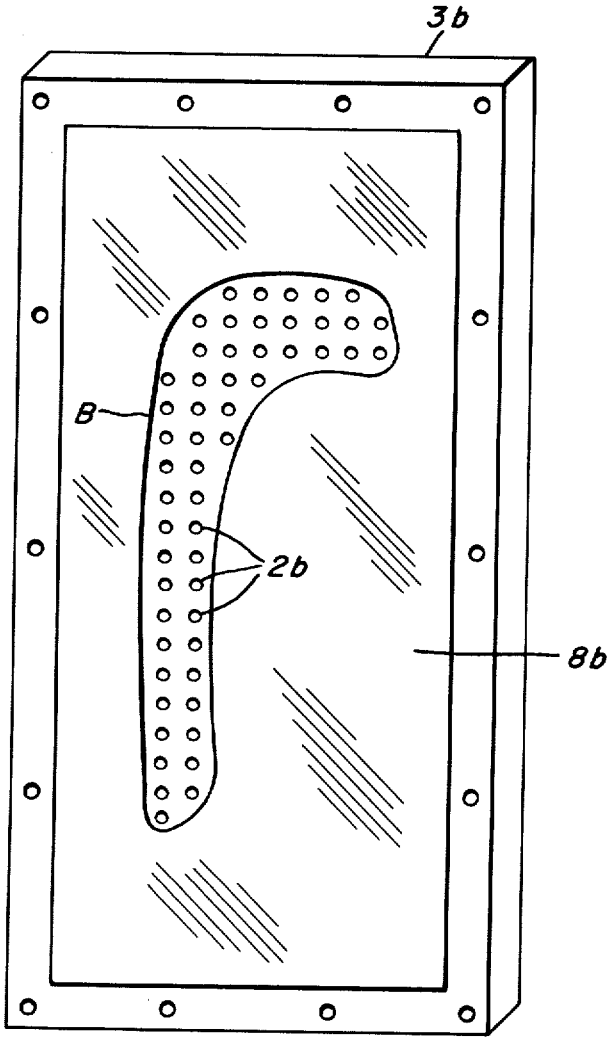
Figure 4:
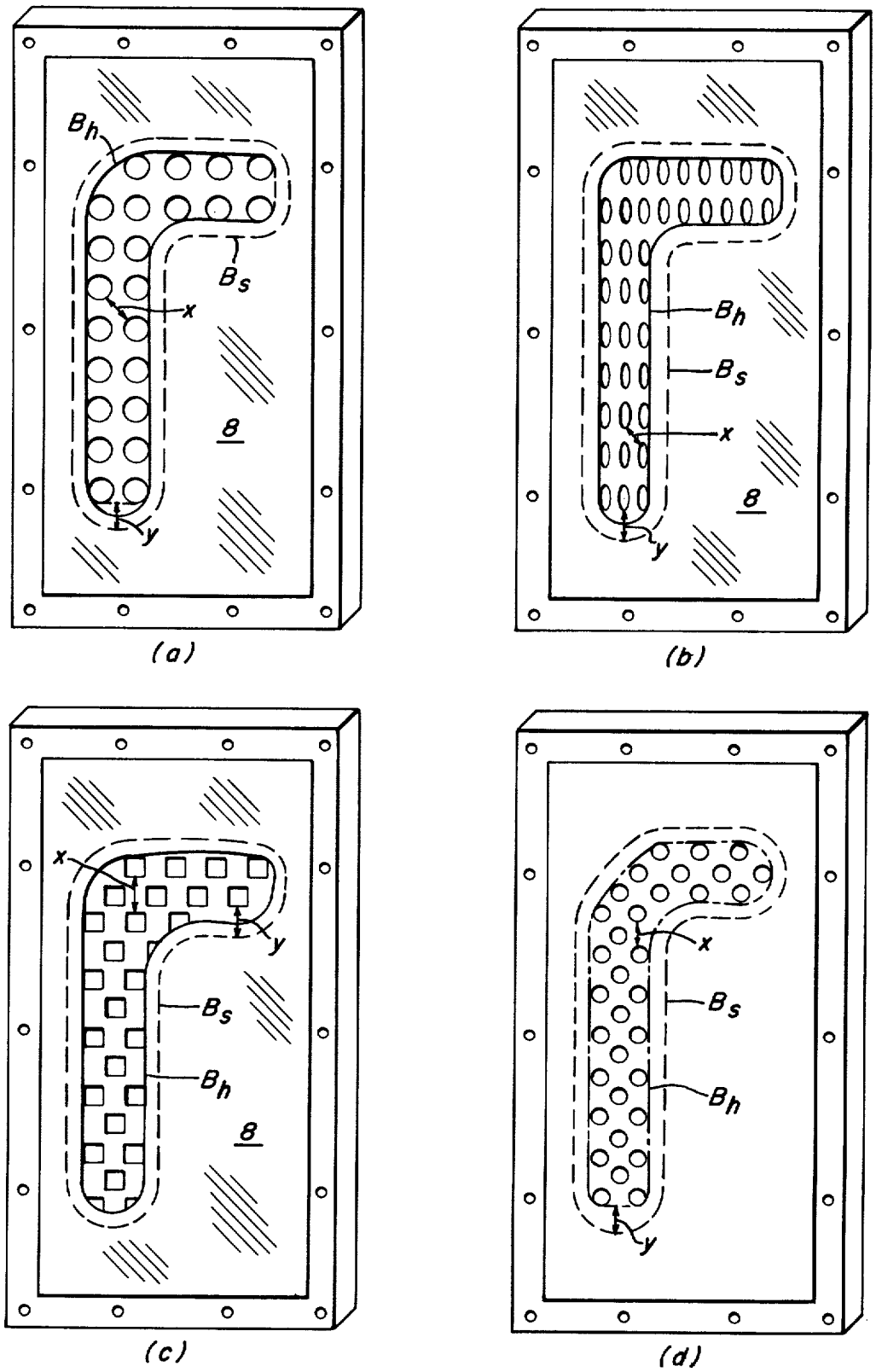

This and other objects and advantages of the invention will become more apparent from reading of the following description when taken in conjunction with the appended claims and the drawings in which:

FIG. 1 is a schematic representation of the housing member of this invention, containing a non-consumable anode, FIG. 2 shows a preferred embodiment employing a separate soluble anode chamber for maintaining the concentration of metal ions within the electrolyte, FIGS. 3*a* and *b* illustrate a preferred means for masking both (a) the recessed configuration within the metal substrate and (b) the front face of the anode housing, FIGS. 4*a* through 4*d* provide alternative embodiments of port openings, and further illustrate the requirements for proper spacing and distribution of such ports, FIGS. 5*a* and 5*b* illustrate the effect of improper plating distance, in the plating of inside corners, and FIGS. 6*a* and 6*b* are representational illustrations of two housing members, specifically adapted for inside corner plating.

The aforementioned difficulties associated with high current density plating of recessed configurations are overcome by the apparatus of this invention which utilizes a principle of electrolyte agitation, somewhat similar to that shown in U.S. Pat. No. 2,695,269; wherein agitation is achieved by forcing the electrolyte through a multiplicity of nozzle ports to cause the electrolyte to issue in a form of jets. Although the principle so illustrated was found effective for reducing concentration polarization around a wire undergoing electroplating, similar such methods employing widely spaced ports were found ineffective for the plating of recessed configurations. Nevertheless, it was found that such jet agitation could be effectively employed to achieve uniform, smooth electrodeposits by critically correlating (i) the applied voltage, (ii) the size and the spacing of the ports, (iii) the force of the discharged jets and (iv) the distance between the front face of the anode housing and the substrate itself, so as to achieve "coalescence" of the emerging jets (illustrated at 4 in FIG. 1).

While it will readily be evident that the apparatus may be employed for electroplating utilizing any of the electrolytic solutions well known to the art, the features and operation of this invention will be described in its specific application to the electrodeposition of copper onto a copper substrate.

One essential feature of the apparatus of this invention is the unique anode housing *h* shown in FIG. 1. With reference thereto, electrolyte from a source (not shown) is pumped under force through inlet means 1 into the housing, and exits through closely spaced holes or ports 2 within the front face 3 in the form of coalescent jets 4. To avoid the possibility of undesirble stray currents, it is preferable that all the faces of the housing will be constructed from an electrically non-conductive material. It is, however, essential that the front face be made of such a non-conductive material. The metal substrate 5 undergoing repair is connected to a source of electromotive force (not shown) as cathode. The face of the substrate may be suitably masked 6 except for the depression 7 which it is desired to fill by the electrodeposition of metal. The rearward facing surface of the front face is similarly masked 8 to form a shape approximately congruent with the shape of the recessed configuration undergoing plating. The proper potential for achieving the desirable high current densities is established through the use of an insoluble anode 9 supported within the housing and spaced from the front face, e.g. at the rear of the housing as shown in FIG. 1. This insoluble anode may be directly connected to the electromotive source. It is preferable, however, that the insoluble anode be connected to the positive pole of the power source through a soluble anode housing which is separate therefrom, as shown in FIG. 2. While both the insoluble anode housing and the substrate are depicted as being immersed beneath the level of the plating electrolyte, it should be understood that such immersion is not a requisite to effective electroplating. Thus, for example, the electrolyte issuing from the housing may simply be conducted to a reservoir tank and recycled, as necessary, back to said inlet means.

Although replenishment of metal ions depleted as a result of electroplating may be achieved simply by the periodic addition of concentrated electrolyte, such replenishment is desirably achieved through the use of a separate consumable anode chamber, for example, as shown in FIG. 2. The chamber 11 may be made from any well known insulative material, e.g. plastic. A series of copper plates 12 is connected to a section of copper rod 13 passing through one side of the enclosure, e.g. through an O-ring seal, to serve as positive connection from the electromotive source (not shown). Electrolyte inlet and outlet connections, 14 and 15 respectively, are provided through another face of the enclosure. Electrical connection between the copper anode plates and the insoluble anode is made, for example, by platinum wire 16 extending through outlet means 15 as shown. In operation, plating solution (e.g. containing $Cu^{++}$ ions) is pumped through consumable anode chamber 11 before reaching the non-consumable anode housing of FIG. 1. The electrolyte passes across the surface of the positively charged copper plates, which act as a source for replenishment of copper ions to the depleted solution. The replenished solution then flows through outlet means 15 to the housing member through the closely spaced ports in the front face of said housing, where it may be recycled directly back to chamber 11 through inlet means 14; or more desirably, is initially collected in a reservoir (not shown) prior to recycling to chamber 11.

Applicability of the apparatus will be better understood in a specific example wherein it is used in a repair of a copper lined continuous casting mold. In view of the high temperature fluxuations which such molds are subjected to; small cracks often occur as a result of stresses caused thereby. Conventionally, these cracks are repaired by grinding out sufficient material so as to remove all traces of the crack. The depression resulting from such a grinding operation is illustrated representationally as 7*a* in FIG. 3*a*. The substrate surface adjacent the depression is masked e.g. by the use of electroplating tape 6*a*. The rearward surface of the front face 3*b* of the housing member is similarly masked, so that the border around the open ports or slots therein forms a shape which is approximately congruent with the shape of the depression 7*a*. Desirably, the border formed by mask 8*b* is slightly smaller, e.g. ¼ inch, than the border formed by the depression, so as to enhance preferential deposition within the deeper portions of the depression.

Proper values for jet flow and voltage are directly proportional, and are best determined empirically. Volume-per-unit time for jet flow is of no use since this will vary according to the number of ports in the front face; however, the force of impingement of individual jet streams can be seen before immersion, and this parameter can be maintained constant regardless of the number of holes in use. For example, if the jet force is such that solution is seen to repel to a distance of ~¼ inch from the front face, a satisfactory deposit is obtained at a potential of ~75 volts, resulting in an average deposition rate of ~0.010 inch/hour at ~170 asf. Higher voltages may cause "treeing", while lower voltages will result in a deposit resembling low-current-density plating i.e., resulting in a poorly adherent, dull finish. If the jet force is reduced, "treeing" may again occur unless voltage is reduced accordingly, in which case an unnecessarily low deposition rate is obtained. The remaining alternative—increasing the jet flow and voltage porportionately—is limited by the distance between individual jets or the distance from the face plate to the mold wall. The significant feature of multiple immersed jets is that the jet streams coalesce at some minimum distance from the jet outlets with the result that a more or less uniform turbulence is obtained. This relative uniformity of turbulence (coalescent jets) is necessary to the uniformity of the deposit. Stronger jet forces could be used if the jets were closer together, or if housing face-to-mold wall distance were significantly increased. In the application described here, the latter arrangement is generally undesirable due to the resultant loss of definition of deposit geometry and the increased voltage necessary to achieve the same current density. Conversely, decreasing the spacing between the jets, results in coalescence occurring at a point closer to the front face of the housing; thereby permitting closer approach to the substrate and lower voltages to achieve the same current density. It may therefore be seen, theoretically at least, that the anode face may be placed a considerable distance from the substrate and nevertheless achieve desirable high current densities simply by increasing the applied voltage and the degree of agitation. However, to realize the full benefits of the instant invention, while utilizing emf sources and pumps within practical limits; it is desirable that the anode face be positioned no more than about 3 inches, and preferably about ¼ to 1 inch, from the substrate undergoing plating. Depending on (i) the applied voltage, (ii) the force of the jets and (iii) the plating distance, i.e. the distance between the housing front face and the substrate; there exist considerable latitude in the size and spacing of the ports. It is, however, essential that the ports, whatever their shape, be spaced sufficiently close and properly be distributed so as to achieve coalescence of the jets. Utilizing the plating distance defined above, it is then possible to prescribe the minimum requirements for such port distribution and port spacing:

i. The maximum spacing between the edges of adjacent ports should be less than the plating distance, and preferably be less than one-half the plating distance. Referring to the illustrative embodiments depicted in FIGS. 4*a* through *d;* this maximum distance between the edges of adjacent ports is symbolized by *x*.

ii. The normal distance from a border $B_h$ circumscribing the ports, to the approximately congruent border $B_s$ of the recessed configuration (superimposed onto the housing front face) should be less than about the 1.5 times the plating distance, but not less than one-half the plating distance. Desirably, this normal distance will be about equal to the plating distance. This maximum distance from $B_h$ to $B_s$ is symbolized by *y* in the illustrative embodiments of FIGS. 4*a* through *d*. It should be understood that when a mask is employed (eg. electroplating tape 8), the border $B_h$ will be the border of such mask only when it actually intersects or is tangent to a port opening. When no mask is employed (FIG. 4*d*) or when the mask does not so intersect a port opening (FIG. 4*b*), then the border $B_h$ is an imaginary outline circumscribing the outer edges of the outermost ports.

iii. Additionally, the total cross-sectional area of the port openings should be no greater than about 4 times the cross-sectional area of the inlet opening (1 in FIG. 1).

For the specific case in which the basic principle of this invention, i.e. coalescent jets, is employed for the electroplating of an inside corner having a radius R (FIGS. 5*a* and 5*b*) certain further minimum requirements must be maintained. Here, the plating distance should be within the range of about 0.3 to 0.9 R, preferably about 0.6 R. If the plating distance is above about 0.9 R, the resultant deposit *k* will "keyhole" — FIG. 5*a*. On the other hand, if the plating distance is below about 0.3 R, there is a tendency for the resultant deposit *r* to "ridge" — FIG. 5*b*.

Alternative embodiments of the housing member of this invention, useful for such inside corner plating, are representationally illustrated in FIGS. 6*a* and 6*b*. In embodiment 6*a*, a linear array of holes, analogous to those of FIG. 1, is employed for such corner plating. However, the requisite feature of coalescent jets (in this case a single sheet of electrolyte) may also be achieved by the use of a thin elongated orifice as shown in FIG. 6*b*. In all cases, the width W of the opening should be less than the radius R. Preferably, W will be less than R/2.

I claim:

1. Apparatus for the high current density electroplating of a recessed configuration within a metal substrate, comprising a. a housing member, which includes;

i. a front face composed of an electrically non-conductive material, said front face having a number of ports, closely spaced and properly distributed for the discharge of electrolyte in the form of coalescent jets, ii. enclosure elements connected to said front face so as to form a substantially enclosed container, wherein one of said elements is fitted with inlet means for entrance of electrolyte into said housing, and iii. a non-consumable electrode, supported within said housing and spaced rearwardly from said front face, b. tank means for the storage of electrolyte, c. conduit and pump means for conducting electrolyte from the tank means to said housing member, said pump means being of sufficient power to urge the electrolyte through said ports with an impingement force sufficient to support said high current densities at the base of the recessed configuration, d. a source of electromotive force of sufficient voltage to effect said high current densities, the positive pole of which is in electrical connection with said non-consumable electrode, as anode, e. means connecting the negative pole of said electromotive source to said substrate, as cathode, f. means for maintaining said front face within a plating distance of less than three inches from said substrate, said housing ports being spaced and distributed so that, in the plane of said front face, (i) the maximum spacing between the edges of adjacent ports is less than said plating distance and (ii) the normal distance from the border $B_s$ around said recessed configuration to a border $B_h$ around said ports, is about 0.5 to 1.5 times said plating distance, and wherein the total cross-sectional area of the port openings is no greater than about four times the cross-sectional area of said inlet means, whereby the jets of electrolyte issuing from said front face are caused to coalesce prior to substantially perpendicular impingement onto said recessed configuration.

2. The apparatus of claim 1, including conduit means for returning electrolyte discharged through said front face back to said tank means.

3. The apparatus of claim 2, wherein said conduit means include a substantially enclosed chamber having (i) ingress means connected to said tank means and (ii) egress means connected to said housing member inlet means, and (iii) supported therein, a consumable electrode composed of the metal being plated; whereby the electrolyte cation concentration, which is depleted as a result of such electroplating, may be replenished; said consumable electrode being connected to the positive pole of said electromotive source.

4. The apparatus of claim 1, in which means (f) is adapted to maintain said plating distance within the range of about ¼ to 1 inch.

5. The apparatus of claim 1, in which said housing ports are spaced and distributed so that said maximum spacing between the edges of adjacent ports is less than one-half said plating distance.

6. The apparatus of claim 4, in which said housing ports are spaced and distributed so that said maximum spacing between the edges of adjacent ports is less than one-half said plating distance.

7. The apparatus of claim 3, in which means (f) is adapted to maintain said plating distance within the range of about ¼ to 1 inch.

8. The apparatus of claim 7, in which said housing ports are spaced and distributed so that said maximum spacing between the edges of adjacent ports is less than one-half said plating distance.

9. The apparatus of claim 1, said apparatus being specifically adapted for the electroplating of inside corners having a radius R, in which said means (f) is adapted to maintain said plating distance within the range 0.3 R to 0.9 R, and in which said ports form an essentially linear array, where the width of said ports, in a direction perpendicular to the linear array, is less than R.

10. The apparatus of claim 3, said apparatus being specifically adapted for the electroplating of inside corners having a radius R, in which said means (f) is adapted to maintain said plating distance within the range 0.3 R to 0.9 R, and in which said ports form an essentially linear array, where the width of said ports, in a direction perpendicular to the linear array, is less than R.

11. The apparatus of claim 10, in which the width of said ports is less than R/2.

12. A process for the high current density electroplating of a recessed configuration within a metal substrate, which comprises utilizing the apparatus of claim 1 to deposit metal ions onto said substrate.

* * * * *